United States Patent [19]

Graham-Troll

[11] Patent Number: 4,696,310

[45] Date of Patent: Sep. 29, 1987

[54] PAPER FEED FOR CIGARETTE MAKING MACHINES

[75] Inventor: Dennis Graham-Troll, Saunderton, England

[73] Assignee: Molins PLC, Great Britain

[21] Appl. No.: 829,988

[22] Filed: Feb. 18, 1986

[30] Foreign Application Priority Data

Feb. 18, 1985 [GB] United Kingdom ..... 8504044

[51] Int. Cl.[4] ..... A24C 5/20

[52] U.S. Cl. ..... 131/105; 101/128; 226/118; 400/196.1; 400/613.2

[58] Field of Search ..... 226/118; 400/196.1, 400/613.2; 101/128; 131/105, 84.1, 94

[56] References Cited

U.S. PATENT DOCUMENTS 4,383,774 5/1983 Yonkers ..... 400/196.1

*Primary Examiner*—V. Millin

*Attorney, Agent, or Firm*—Antonelli, Terry & Wands

[57] ABSTRACT

A reservoir for a bobbin changer for cigarette paper or a similar paper web includes, adjacent to an inlet (15) at which the paper (10) enters the reservoir, a movable deflector (20) arranged to engage and deflect the paper as it enters the reservoir (at least while paper is being accumulated in the reservoir) and to promote folding of the paper into loops in which the paper can safely be stored in the reservoir. The deflector is preferably pivoted and is arranged to be pushed away from the inlet by the accumulating loops of paper until the deflector reaches a nearly vertical position whereupon the bunched up loops of paper drop into the reservoir.

8 Claims, 2 Drawing Figures

PAPER FEED FOR CIGARETTE MAKING MACHINES

Cigarette making machines and similar machines such as filter making machines commonly include an automatic bobbin changer whereby a spent bobbin of paper is automatically replaced by a full bobbin so that the machine can continue to run without interruption during bobbin changing. A common type of bobbin changer for that purpose is described generally in British patent specification No. 1086065 and includes a reservoir through which the paper passes in running from the operative bobbin to the rod forming part of the machine. When a bobbin is about to expire, the feed rate of paper into the reservoir is automatically increased to accumulate a quantity of paper in the reservoir. This allows the machine to continue running while splicing of paper from a fresh bobbin onto the trailing end of the paper on the spent bobbin takes place at a location upstream of the reservoir where the paper feed is stopped for that purpose.

Problems have tended to occur at the high speeds at which modern cigarette making machines are designed to operate (of the order of 8,000 cigarettes per minute) since the reservoir is required to store a correspondingly increased quantity of paper prior to bobbin changing. The necessary increase in reservoir capacity can readily be achieved by enlarging the internal volume of the reservoir, but one particular problem which arises is that there is a danger of the paper twisting in the reservoir and thus jamming or becoming creased or otherwise damaged as it leaves the reservoir.

A reservoir for a bobbin changer according to one aspect of this invention includes, adjacent to the inlet at which the paper enters the reservoir, a movable deflector arranged to engage and deflect the paper as it enters the reservoir (at least while paper is being accumulated in the reservoir) and to promote folding of the paper into loops in which the paper can safely be stored in the reservoir. The deflector is movably mounted (preferably pivoted) so as to be able to move away from the paper inlet under the pressure of the accumulated loops of paper and against a light restraining force, the latter being preferably provided by a balance weight. Thus the deflector causes the paper to "bunch up" initially in looped formation adjacent to the deflector. The deflector moves away from the inlet when the pressure of the paper causes it to do so, allowing the bunched up paper then to move into the reservoir; the restoring force then returns the deflector to its initial position and further incoming paper bunches up adjacent to it as before, and the reservoir-filling process continues in that way. The looped formation of the paper in the reservoir prevents twisting of the paper.

Figure 1:
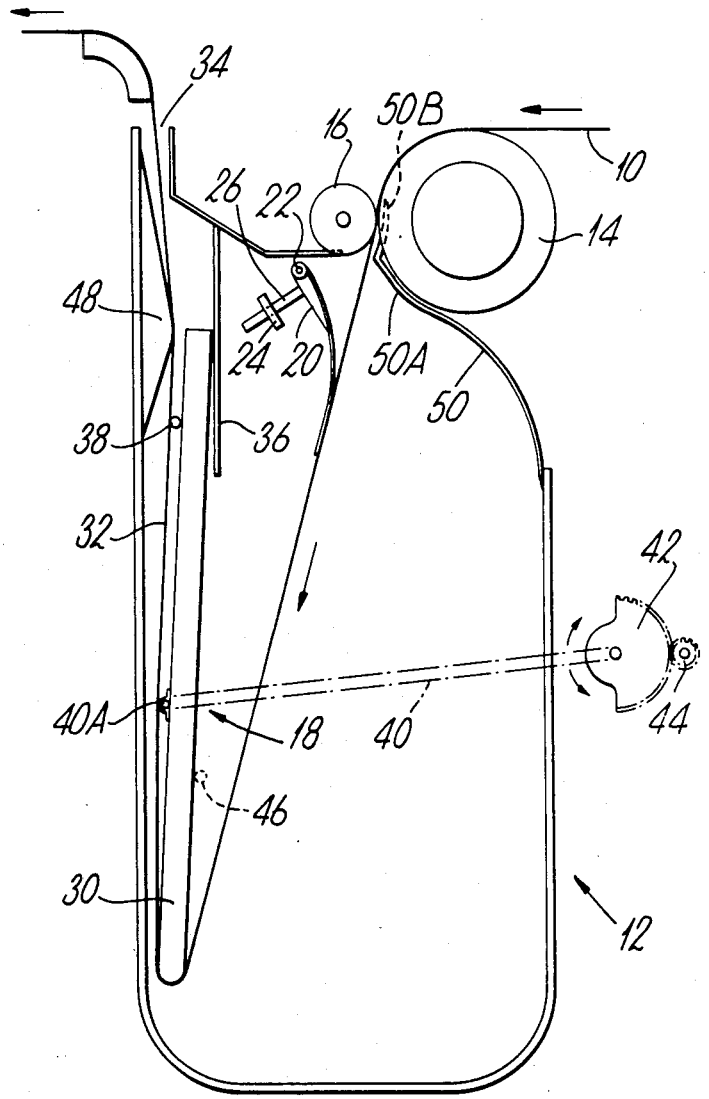
Figure 2:
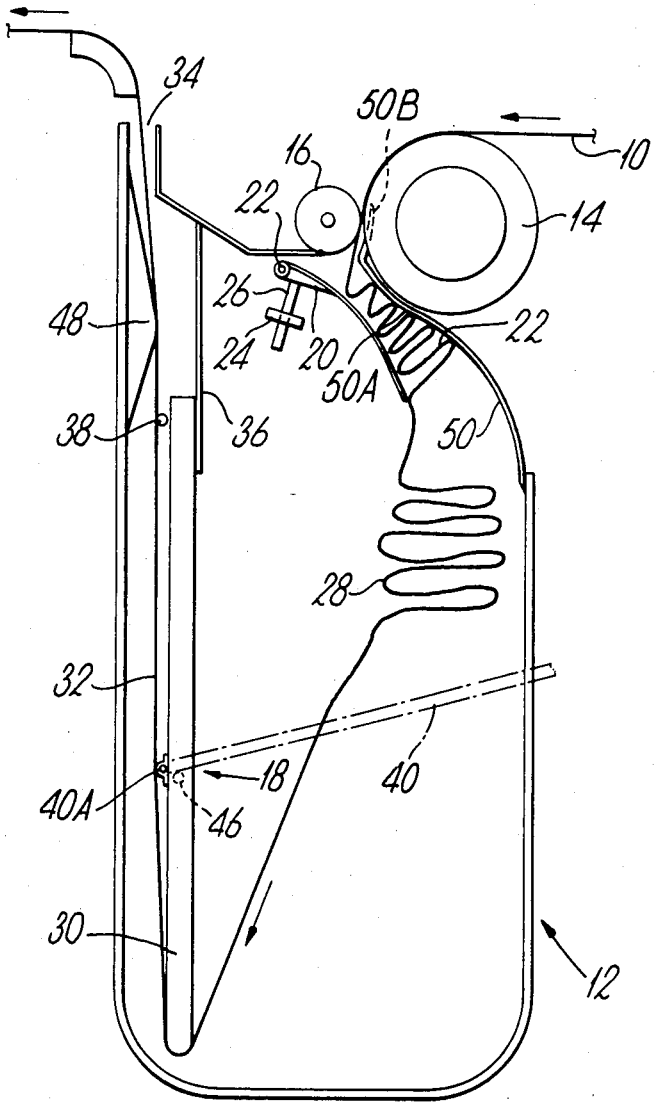

A second aspect of this invention, concerned with a tension sensing arrangement comprising a vertically movable false inner wall will be described with reference to the accompanying drawings. In these drawings:

FIG. 1 shows a reservoir according to this invention while paper is passing through it without accumulating in the reservoir; and FIG. 2 shows the reservoir at a stage of accumulating paper in preparation for a bobbin change.

As identified particularly in FIG. 1, a paper web 10 is fed into a reservoir 12 by a capstan roller 14 with the aid of a pinching roller 16, the paper inlet 15 to the reservoir being accordingly the gap between the rollers 14 and 16. During normal use, the path of the paper through the reservoir extends around a tension sensing member 18 which moves approximately vertically in response to the degree of tension in the paper and controls the speed of the capstan roller 14. The member 18 is of a new construction and is described below.

In order to prepare for a bobbin change, the speed of the capstan roller 14 is automatically increased to accumulate paper in the reservoir; the tension sensing member 18 at that stage has no effect. Paper is required to accumulate in the reservoir in a series of tight folds or loops without creasing. In order to promote folding and thus prevent twisting of the paper, a deflector member 20 pivoted at 22 is mounted within the reservoir at a position such that the incoming paper impinges on the deflector member and is caused to bunch up in looped formation adjacent to the deflector in the area shown at 22 in FIG. 2. As the accumulated paper in the area 22 increases, it will urge the deflector in a clockwise direction against a light restraining force provided by a balance weight 24 screwed on a threaded stem 26 fixed to the deflector. The bunched up paper is initially prevented by frictional contact with the deflector from dropping into the reservoir; however, as the "bunch" increases in size and thus becomes heavier, while at the same time urging the deflector towards a generally vertical position, a point is reached at which the bunch drops into the reservoir. The deflector then swings back in a counter-clockwise direction to start the formation of the next bunch. FIG. 2 shows diagrammatically a bunch 28 formed before the bunch 22.

Thus paper is accumulated in the reservoir in a series of tightly looped bunches which eventually fill substantially the entire space within the reservoir in the area below the deflector.

While the machine is running normally, without accumulating paper in the reservoir, the tension in the paper web within the reservoir holds the deflector in the position shown in FIG. 1. The balance weight 24 helps to ensure that the paper is lightly tensioned. Frictional contact with the lower portion of the deflector 20 (aided possibly by static electricity) also keeps the web slightly tensioned as it leaves the deflector during the initial stage of building up the first bunch of paper.

Contact between the web and the capstan roller 14 after the web has entered the reservoir is prevented by curved upper part 50A of a fixed wall 50. A narrow portion 50B at the upper and of the wall 50 is bent so as to enter a circumferential groove in the roller 14 and is shaped so as to deflect the web to the left towards the pivoted deflector member 20.

As already mentioned, the tension sensing arrangement 18 is different from that used previously. It comprises a vertically movable false inner wall 30 which separates from the folded paper in the reservoir the upwardly extending paper run 32 approaching the outlet 34 from the reservoir. Without the wall 30, and with the reservoir exit at the top left-hand corner as shown, the paper leaving the reservoir previously tended to drag upwards and disturb the folded paper, thus tending to cause creasing or jamming of the folded paper.

The wall 30 is vertically movable, being constrained against tilting by a fixed wall 36 and a pin 38, and is connected to an end portion 40A of a rod 40 mounted on a segment gear 42 meshing with a capstan speed regulator 44. It will be understood that the rod 40 lies behind the reservoir, its end portion 40A being bent forward to enter the reservoir through an appropriate arcuate slot (not shown). Tension in the paper web tends to lift the wall 18 (which is of wood) and thus rotates the rod 40 in a clockwise direction; such rotation of the rod cause the regulator to increase the speed of the capstan roller, whereas rotation in the opposite direction reduces the speed of the capstan roller. While paper is being accumulated in the reservoir, the rod 40 rests on a stop 46.

The tension sensing arrangement is useful in its own right. In other words, it may be incorporated as an improvement to a reservoir which does not include the above described deflector 20.

The reservoir also includes a suctional web tensioning part 48 in accordance with our British patent specification No. 2051748.

I claim:

1. A reservoir for a bobbin changer for cigarette paper or a similar paper web including, adjacent to an inlet at which the paper enters the reservoir, a deflector which is mounted in the reservoir for movement toward and away from the inlet and is arranged to engage and deflect the paper as it enters the reservoir, at least while paper is being accumulated in the reservoir, and to promote the folding of the paper into loops in which the paper can safely be stored in the reservoir.

2. A reservoir according to claim 1 in which the deflector is arranged to move progressively away from the paper inlet under the pressure of the accumulated loops of paper.

3. A reservoir according to claim 2 in which the deflector is pivotally mounted.

4. A reservoir according to claim 2 in which movement of the deflector under the influence of pressure from the accumulated loops of paper is resisted by a restraining force.

5. A reservoir according to claim 4 in which the restraining force is provided by a balance weight mounted on the deflector.

6. A reservoir according to claim 1 in which the normal path of the paper through the reservoir is such that the paper engages the deflector and, as a result of tension in the paper, holds the deflector away from the inlet.

7. A reservoir for a bobbin changer for cigarette paper or a similar paper web including, adjacent to an inlet at which the paper enters the reservoir, a movable deflector arranged to engage and deflect the paper as it enters the reservoir, at least while paper is being accumulated in the reservoir, and to promote folding of the paper into loops in which the paper can safely be stored in the reservoir, and a paper tension sensing arrangement for controlling the speed of a roller feeding paper into the reservoir and comprising a vertically movable false inner wall arranged to rest on the paper in the reservoir and to control the roller speed in response to the position of the wall, the wall also serving to separate, from the paper leaving the reservoir during a bobbin changing operation, the looped paper accumulated in the reservoir.

8. A reservoir for a bobbin changer for cigarette paper or a similar paper web including a paper tension sensing arrangement for controlling the speed of a roller feeding paper into the reservoir and comprising a vertically movable false inner wall arranged to rest on the paper in the reservoir and to control the roller speed in response to the position of the wall, the wall also serving to separate, from the paper leaving the reservoir during a bobbin changing operation, the looped paper accumulated in the reservoir.

* * * * *